US006827048B2

(12) United States Patent
Kinomoto et al.

(10) Patent No.: US 6,827,048 B2
(45) Date of Patent: Dec. 7, 2004

(54) COOLING SYSTEM FOR MARINE ENGINE

(75) Inventors: Naoki Kinomoto, Shizuoka (JP); Tetsuya Ishino, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 135 days.

(21) Appl. No.: 10/112,809

(22) Filed: Mar. 29, 2002

(65) Prior Publication Data

US 2003/0024491 A1 Feb. 6, 2003

(30) Foreign Application Priority Data

Aug. 6, 2001 (JP) ..... 2001-238303

(51) Int. Cl.[7] ..... B63H 21/38
(52) U.S. Cl. ..... 123/41.14; 123/41.31
(58) Field of Search ..... 123/41.31, 41.14

(56) References Cited

U.S. PATENT DOCUMENTS

| | | | | |
|---|---|---|---|---|
| 5,048,467 A | | 9/1991 | Kojima | |
| 5,067,448 A | * | 11/1991 | Nakase et al. | 123/41.31 |
| 5,251,577 A | | 10/1993 | Kojima | |
| 5,555,855 A | * | 9/1996 | Takahashi | 123/41.31 |
| 5,873,330 A | * | 2/1999 | Takahashi et al. | 123/41.31 |
| 5,885,121 A | | 3/1999 | Nanami et al. | |
| 6,053,784 A | * | 4/2000 | Takahashi | 123/41.14 |
| 6,135,064 A | * | 10/2000 | Logan et al. | 123/41.14 |
| 6,302,754 B1 | | 10/2001 | Kashima | |
| 6,331,127 B1 | * | 12/2001 | Suzuki | 123/41.31 |
| 6,675,749 B2 | * | 1/2004 | Osakabe | 123/41.31 |

FOREIGN PATENT DOCUMENTS

JP 10-238358 9/1998

OTHER PUBLICATIONS

Copy of Copending application; Application No. 10/060,866; Filed Jan. 29, 2002 (Our Reference: FS.17465US0A).

* cited by examiner

*Primary Examiner*—Henry C. Yuen
*Assistant Examiner*—J A Benton
(74) *Attorney, Agent, or Firm*—Knobbe, Martens, Olson & Bear, LLP

(57) ABSTRACT

A cooling system particularly suited for use in a small watercraft, which supplies coolant to, and evacuates coolant from, an engine of the watercraft. The engine includes an engine body defining at least one water jacket therein. An engine coolant supply passage desirably routes the coolant into thermal communication with a portion of an exhaust system, such as an exhaust manifold, before supplying the coolant to the water jacket of the engine. When the engine is shut off, coolant is permitted to drain from the water jacket through a drain passage. The drain passage is connected to the coolant supply passage at a position upstream from the exhaust system such that coolant draining from the engine travels in a reverse direction through the supply passage and is drained from the watercraft cooling system. Upon normal operation of the engine, a restriction orifice within the drain passage permits only a relatively small amount of coolant to be supplied to the engine water jacket, without being routed into thermal communication with the exhaust system.

30 Claims, 9 Drawing Sheets

COOLING SYSTEM FOR MARINE ENGINE

PRIORITY INFORMATION

This application is based on, and claims priority to, Japanese Patent Application No. 2001-238303, filed Aug. 6, 2001, the entire contents of which are expressly incorporated by reference herein.

BACKGROUND OF THE INVENTION

1. Field of the Invention

The present invention is related to engine cooling systems. More particularly, the present invention is directed to an engine cooling system particularly suited for incorporation in a small watercraft.

2. Description of the Related Art

Personal watercraft, like other applications that use internal combustion engines for propulsion, are experiencing considerable public and governmental pressure to improve not only their performance, but also their exhaust emissions level. For example, due at least in part to the emissions generated by two-stroke powered watercraft, certain recreational areas have banned the operation of such watercraft. These bans have decreased the popularity of personal watercraft, and have caused manufacturers of these types of watercraft to consider replacing conventional two-stroke type internal combustion engines with four-stroke engines to power the watercraft and/or other means to reduce emissions levels.

Although typical four-stroke type engines inherently produce less exhaust emissions than similar two-stroke engines, it nonetheless remains important to maintain the operating temperature of the four-stroke engine within a particular temperature range in order to fully realize the reduced emissions levels. For this purpose, a temperature-actuated valve, or a thermostat, is typically employed within the cooling system of the watercraft to maintain the desired operating temperature of the engine.

However, the thermostat is typically located downstream from the engine. Because the cooling water is typically supplied by the jet pump unit of the watercraft, the temperature of the cooling water supplied to the cooling system may over-cool the engine if the watercraft is operating in a body of water below a certain temperature. In an effort to solve this problem, some marine engines route the cooling water through a portion of the exhaust system before delivering it to the engine.

SUMMARY OF THE INVENTION

One aspect of the present invention is the realization that although it is preferable to route the cooling water through an exhaust manifold portion of the exhaust system, such a coolant flow-path may lead to drainage problems of the cooling system when the watercraft engine has been shutdown. For example, certain cooling jackets may not drain when the engine has been stopped, because of their position relative to other cooling system components. The drainage problem may result from the exhaust manifold being positioned above an inlet to the water jacket of the engine. Accordingly, in a preferred embodiment, the cooling system includes a separate drain passage in communication with the water jacket of the engine. The drain passage is configured to drain water from the water jacket of the engine so that the coolant supply passage may be routed through vertically higher components of the exhaust system, such as the exhaust manifold, without jeopardizing the draining of the cooling system when the engine is not running.

Accordingly, one aspect of the present invention involves a small watercraft comprising a hull defining an engine compartment. An internal combustion engine is supported within the engine compartment and drives a propulsion device. The engine has an engine body defining a cylinder and a cooling jacket at least partially surrounding the cylinder. A cooling system is in fluid communication with the cooling jacket and supplies cooling fluid to the cooling jacket through a supply passage. A portion of the supply passage is above a portion of the cooling jacket and a drain passage communicates with a lower portion of the cooling jacket. The drain passage is configured to drain cooling fluid from the cooling jacket.

Another aspect of the present invention involves a method of draining cooling fluid from a small watercraft engine having a cooling jacket at least partially surrounding a cylinder of the engine. The method comprises supplying the cooling fluid to the engine through a supply passage. The method further includes routing the supply passage into thermal communication with an exhaust manifold of the engine at a height above a portion of the cooling jacket and routing the supply passage into fluid communication with the cooling jacket to supply the cooling fluid to the cooling jacket and cool the engine while it is running. The method also includes allowing the cooling fluid to drain from a lower portion of the cooling jacket through a drain passage after the engine has stopped running.

Yet another aspect of the present invention involves a marine engine comprising an engine body defining a cylinder and a cooling jacket at least partially surrounding the cylinder. A cooling system is in fluid communication with the cooling jacket and supplies cooling fluid to the cooling jacket through a supply passage. A portion of the supply passage is above a portion of the cooling jacket. A drain passage communicates with a lower portion of the cooling jacket, the drain passage being configured to drain cooling fluid from the cooling jacket.

BRIEF DESCRIPTION OF THE DRAWINGS

The above-mentioned and other features of the present invention are described below with reference to drawings of a preferred embodiment of an engine cooling system for a watercraft. The illustrated embodiment of the cooling system is intended merely to illustrate, but not to limit, the invention. The drawings contain ten figures.

DETAILED DESCRIPTION OF THE PREFERRED EMBODIMENT

With reference to FIGS. 1–10, an improved engine cooling system for a watercraft 20 is described below. The cooling system allows the engine, and various components thereof, to be more precisely cooled so as to substantially prevent incomplete combustion. The cooling system also promotes draining of cooling fluid from the engine when the watercraft 20 is not in use.

Although the present engine cooling system is illustrated in connection with a personal watercraft 20, the illustrated engine can be used with other types of watercrafts as well, such as, for example, but without limitation, small jet boats and the like. Alternative embodiments of the present invention will become readily apparent to those of skill in the art from the following detailed description of the preferred embodiment having reference to the attached figures, the invention not being limited to the preferred embodiment disclosed.

Before describing the cooling system of the watercraft 20, exemplary features of the personal watercraft 20 will first be described in general detail to assist the reader's understanding of the environment of use. The watercraft 20 will be described in reference to a coordinate system where a longitudinal axis extends from bow to stern and a lateral axis from port side to the starboard side, normal to the longitudinal axis. In addition, relative heights are expressed as elevations in reference to the undersurface of the watercraft 20. In various figures, an arrow $F_R$ is used to note the direction in which the watercraft 20 travels during normal forward operation.

Figure 1:
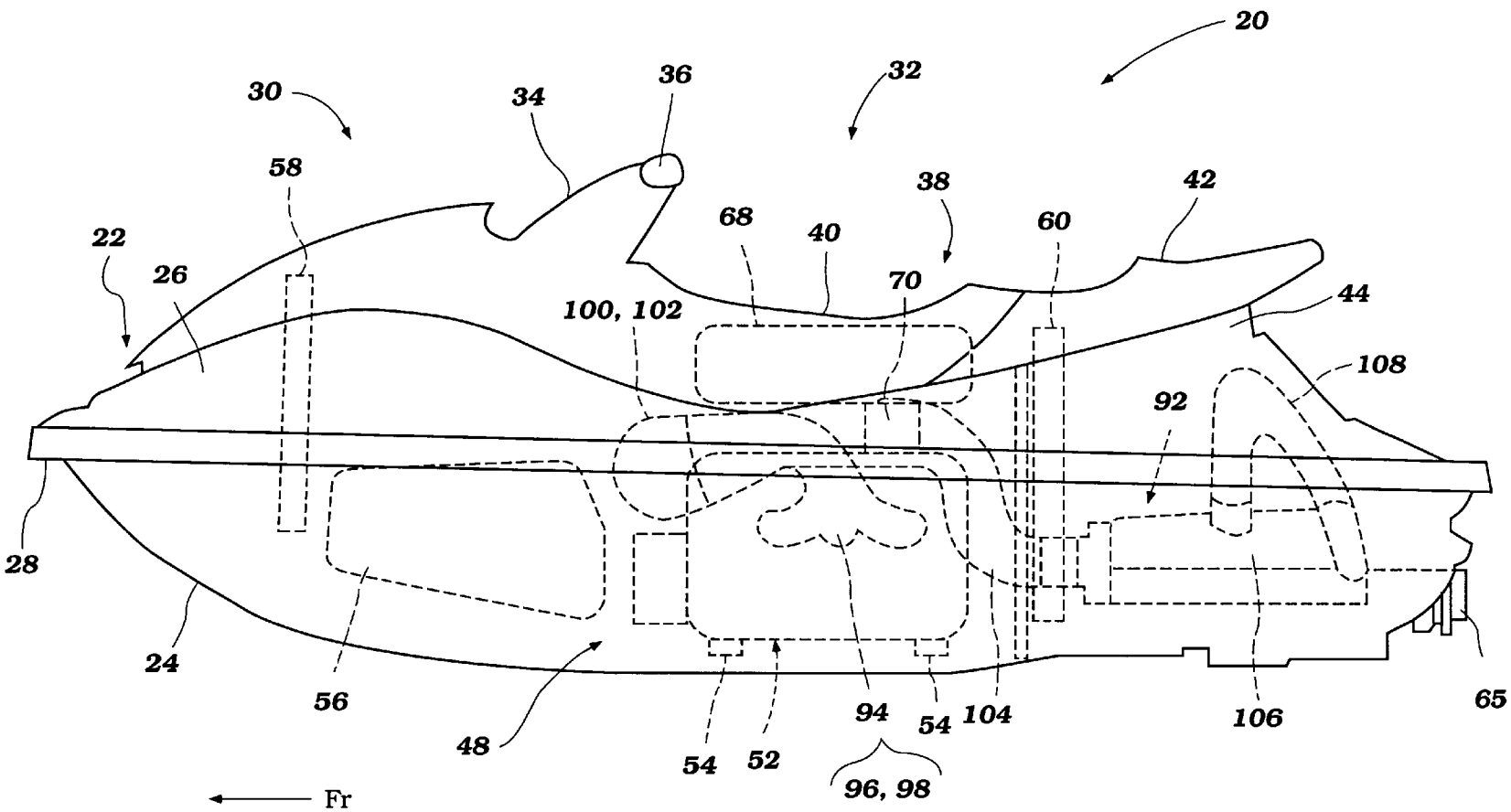
FIG. 1 is a side elevational view of a personal watercraft having a cooling system constructed in accordance with a preferred embodiment of the present invention, with certain internal components (e.g., an engine) schematically illustrated in phantom.

The watercraft 20 has a hull, indicated generally by the reference numeral 22. The hull 22 can be made of any suitable material, however, a presently preferred construction utilizes molded fiberglass reinforced resin. The hull 22 generally has a lower hull section 24 and an upper deck section 26, as shown in FIG. 1. A bond flange 28 can connect the lower hull section 24 to the upper deck section 27. Of course, any other suitable means may be used to interconnect the lower hull section 24 and the upper deck section 26. Alternatively, the lower hull section 24 and the upper deck section 26 may be integrally formed.

As viewed in the direction from the bow to the stern of the watercraft 20, the upper deck section 26 includes a bow portion 30 and a rider's area 32. Between the bow portion 30 and the rider's area 32, a control mast 34 is provided which supports a handlebar assembly 36. The handlebar assembly 36 may also carry a variety of controls of the watercraft 20, such as, for example, a throttle control, a start switch and a lanyard switch (not shown).

The rider's area 32 includes a seat assembly 38 that is formed by at least one seat cushion and, preferably, by a forward seat cushion 40 and a rearward seat cushion 42. The seat assembly 38 is supported on a raised pedestal 44. The raised pedestal 44 forms a portion of the upper deck 26 and has an elongated shape that extends longitudinally along the center plane $C_P$ of the watercraft 20. The seat cushions 40, 42 desirably are removably attached to a top surface of the raised pedestal 44 by one or more latching mechanisms (not shown) and cover the entire upper end of the pedestal 44 for rider and passenger comfort.

Figure 2:
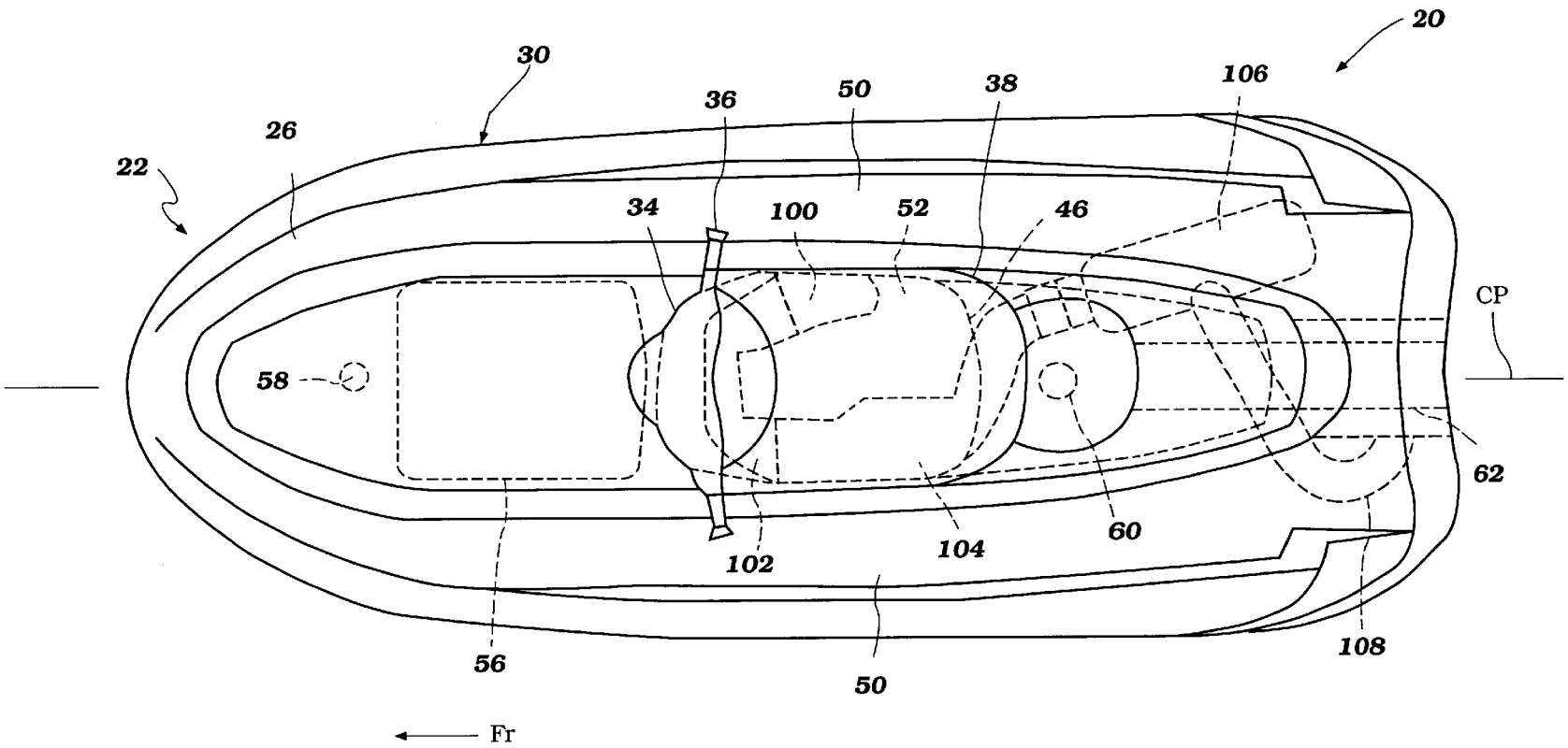
FIG. 2 is a top plan view of the watercraft of FIG. 1.

With reference to FIG. 2, an engine access opening 46 is located in the upper surface of the pedestal 44. The axis opening 46 opens into an engine compartment 48 formed within the hull 22. One or both of the seat cushions 40, 42 normally cover and seal the access opening 46. When the seat cushion, or cushions 40, 42 are removed, the engine compartment 48 is accessible through the access opening 46.

The upper deck portion 26 of the hull 22 advantageously includes a pair of generally planer areas positioned on opposite sides of the seat pedestal 44, which define foot areas 50. The foot areas 50 extend generally along and parallel to the sides of the pedestal 44. In this position, the operator and any passengers sitting on the seat assembly 38 can place their feet on the foot areas 50 during normal operation of the watercraft 20. A non-slip (e.g., rubber) mat desirably covers the foot areas 50 to provide increased grip and traction for the operators and passengers.

With reference to both FIGS. 1 and 2, an engine 52 is supported within the engine compartment 48 in any suitable manner. Preferably, the engine 52 is mounted to a liner (not shown) of the lower hull portion 24 within assembly of resilient engine mounts 54, as is known in the art. Advantageously, the resilient engine mounts 54 attenuate engine vibrations transmitted to the hull 22 of the watercraft 20.

A fuel tank 56 is preferably arranged forwardly from the engine 52. A fuel filler conduit (not shown) preferably extends between the fuel tank 56 and the upper deck portion 26, and terminates in a fuel filler cap (not shown). Thus, access to the fuel tank 56 can be gained by removing the filler cap.

The watercraft 20 includes at least one ventilation duct. In the illustrated embodiment, a forward ventilation duct 58 and a rearward ventilation duct 60 are provided. Each of the ventilation ducts 58, 60 are configured to guide air into and out of the engine compartment 48. Except for the ventilation ducts 58, 60, or any other ventilation devices (not shown) the engine compartment 48 is desirably substantially sealed so as to enclose the engine 52 of the watercraft 20 from the body of water in which the watercraft 20 is operated.

The lower hull section 24 is designed such that the watercraft 20 planes or rides on a minimum surface area at the aft end of the lower hull 24 in order to optimize the speed and handling of the watercraft 20 when up on plane. For this purpose, the lower hull section 24 generally has a V-shaped configuration formed by a pair of inclined sections that extend outwardly from a keel of the hull to the hull's side walls at a dead-rise angle. The inclined sections also extend longitudinally from the bow toward the transom of the lower hull 24. The side walls are generally flat and straight near the stem of the hull 24 and smoothly blend toward the longitudinal center of the watercraft 20 at the bow 30. The lines of intersection between the inclined sections and the corresponding side walls form the outer chines of the lower hull section 24.

Toward the transom of the watercraft 20, the inclined sections of the lower hull 24 extend outwardly from a recessed channel, or tunnel 62, that extends upwardly toward the upper deck 26. The tunnel 62 generally has a parallelepiped shape and opens through the transom of the watercraft 20.

Figure 6:
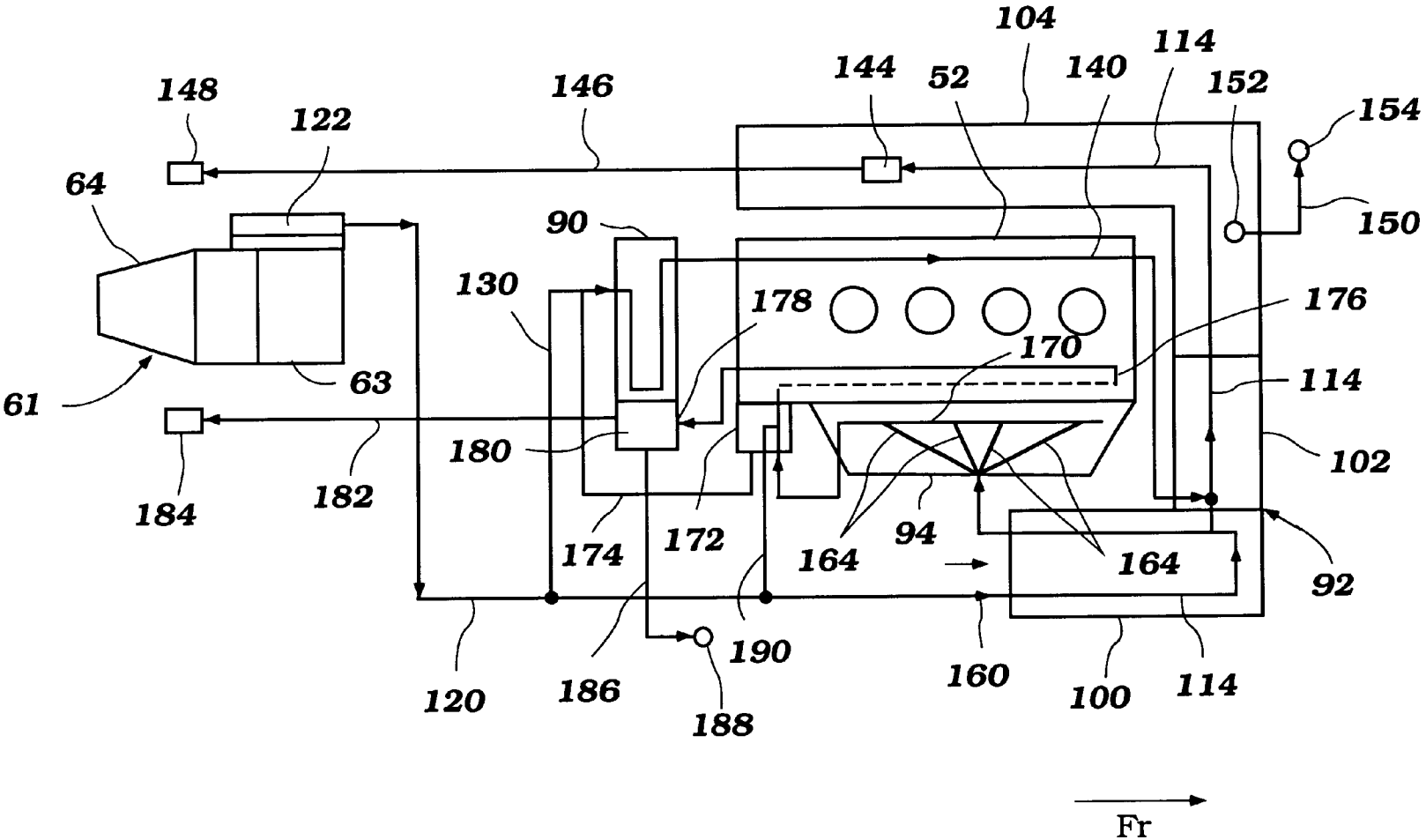
FIG. 6 is a schematic representation of the cooling system included in the engine shown in FIG. 3, particularly showing coolant passage connections between various components of the engine.

A jet pump unit 61 (shown schematically in FIG. 6) is mounted within the tunnel 62 and includes an inlet formed in the lower surface of the lower hull section 24 which opens into a gullet of an intake duct leading to the jet pump unit 61. The intake duct leads to an impeller housing 63 (FIG. 6) in which an impeller (not shown) of the jet pump 61 operates. The impeller housing 63 also acts as a pressurization chamber and delivers a pressurized flow of water from the impeller housing 63 to a discharge nozzle 64 (FIG. 6).

A steering nozzle 65 is supported at a downstream end of the discharge nozzle 64 by a pair of vertically extending pivot pins. In an exemplary embodiment, the steering nozzle 65 has an integral lever on one side that is coupled to the handlebar assembly 36 through, for example, a bowden-wire actuator, as known in the art. In this manner, an operator of the watercraft 20 can move the steering nozzle to affect directional changes of the watercraft 20.

Desirably, a ride plate (not shown) covers a portion of the tunnel 62 behind the inlet opening to close the jet pump unit 61 within the tunnel 62. In this manner, the lower opening of the tunnel 62 is closed to provide a planing surface for the watercraft 20.

Desirably, the engine 52 is an internal combustion engine and powers the jet pump unit 61 of the watercraft 20. In the illustrated embodiment, the engine 52 includes four inline cylinders and operates on a four cycle (i.e., four-stroke) principle. The engine 52 is positioned such that the row of cylinders is generally parallel to the longitudinal axis of the watercraft 20, running from bow to stern. The axis of each cylinder is desirably inclined relative to a vertical central plane of the watercraft 20, in which the longitudinal axis of the watercraft 20 lies. This engine type, however, is merely exemplary. Those skilled in the art will readily appreciate that the present cooling system can be used with a variety of engine types having other numbers of cylinders, having other cylinder arrangements (e.g., vertical, V-type, W-type), and operating on other combustion principles (e.g., two-stroke, diesel, and rotary principles).

A fuel supply system delivers fuel from the fuel tank 56 to the engine 52 in a manner known in the art. Although not illustrated, at least one pump desirably delivers fuel from the fuel tank 56 to the engine 52 through one or more fuel lines (not shown). The fuel lines extend to charge-formers, which are configured to deliver charges of fuel to the combustion chambers of the engine 52 through inlet passages. The charge-formers may be of any suitable arrangement, including carburetors, induction passage fuel injectors, or direct-inject fuel injectors.

Figure 3:
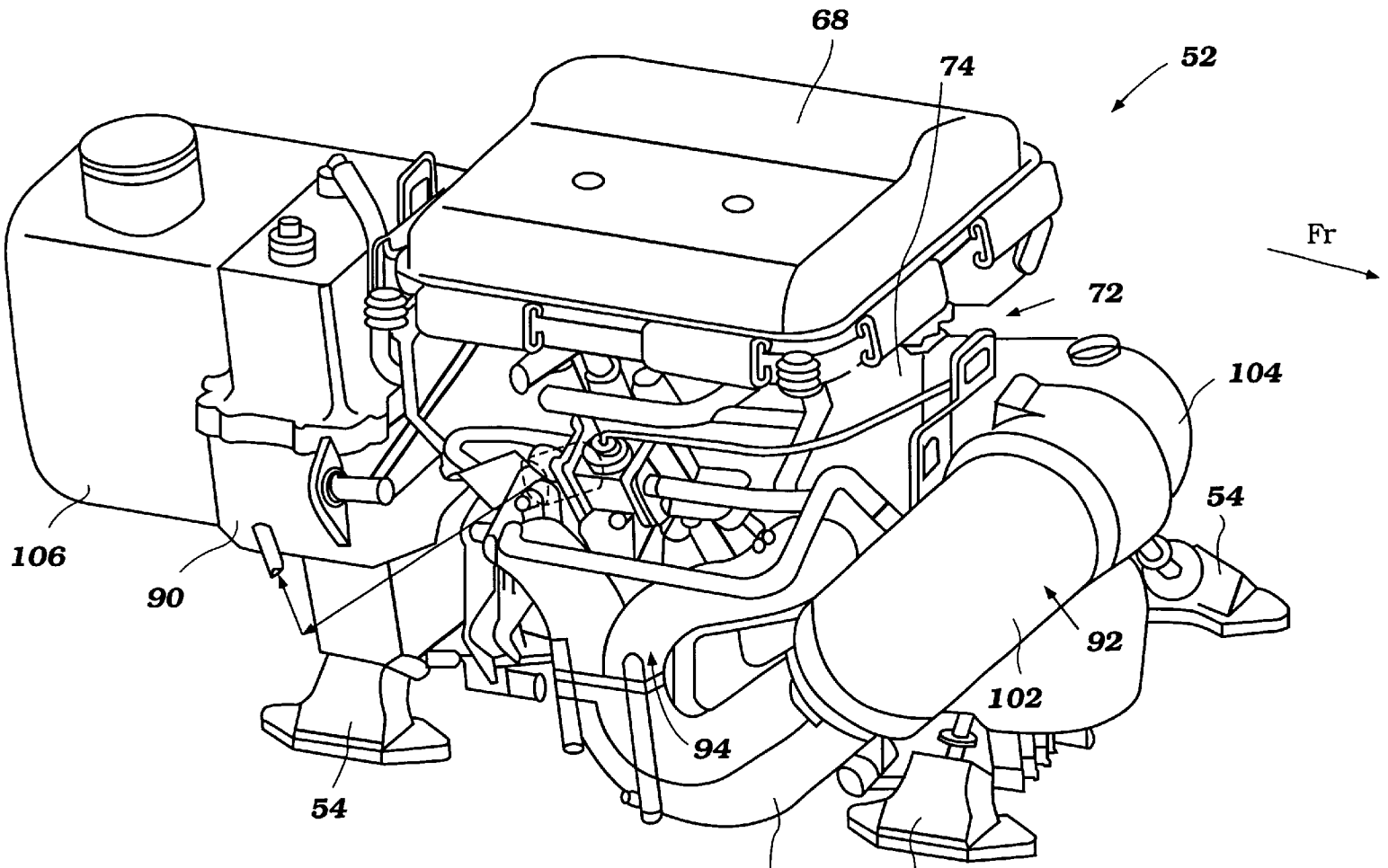
FIG. 3 is a front, top and starboard side perspective view of the engine shown in FIG. 1.

With reference to FIGS. 1–3, the engine 52 typically draws air from the engine compartment 48 through an engine air intake system. In the illustrated embodiment, the engine air intake system comprises an air intake chamber 68 positioned over the engine 52. The intake air chamber 68 includes an inlet 70 defined in a lower wall of the chamber 68. The inlet 70 extends upwardly into an interior of the chamber 68. An air filter element (not shown) surrounds the interior end of the inlet 70 and is desirably sealed against the upper and lower internal surfaces of the chamber 68 such that air entering the chamber 68 through the inlet 70 must pass through the air filter element. Preferably, the air filter element includes both a water-resistant element and an oil-resistant element, with the water-resistant element being positioned upstream from the oil-resistant element along the direction of normal air flow.

The intake air chamber 68 also includes apertures for communicating with the intake passages. The charge-formers are arranged to meter an amount of air entering the intake passages and, thus, the combustion chamber of the engine, from the air intake chamber 68. In a preferred embodiment, the charge-formers are positioned within the air intake chamber 68 so as to be protected from damage.

Figure 5:
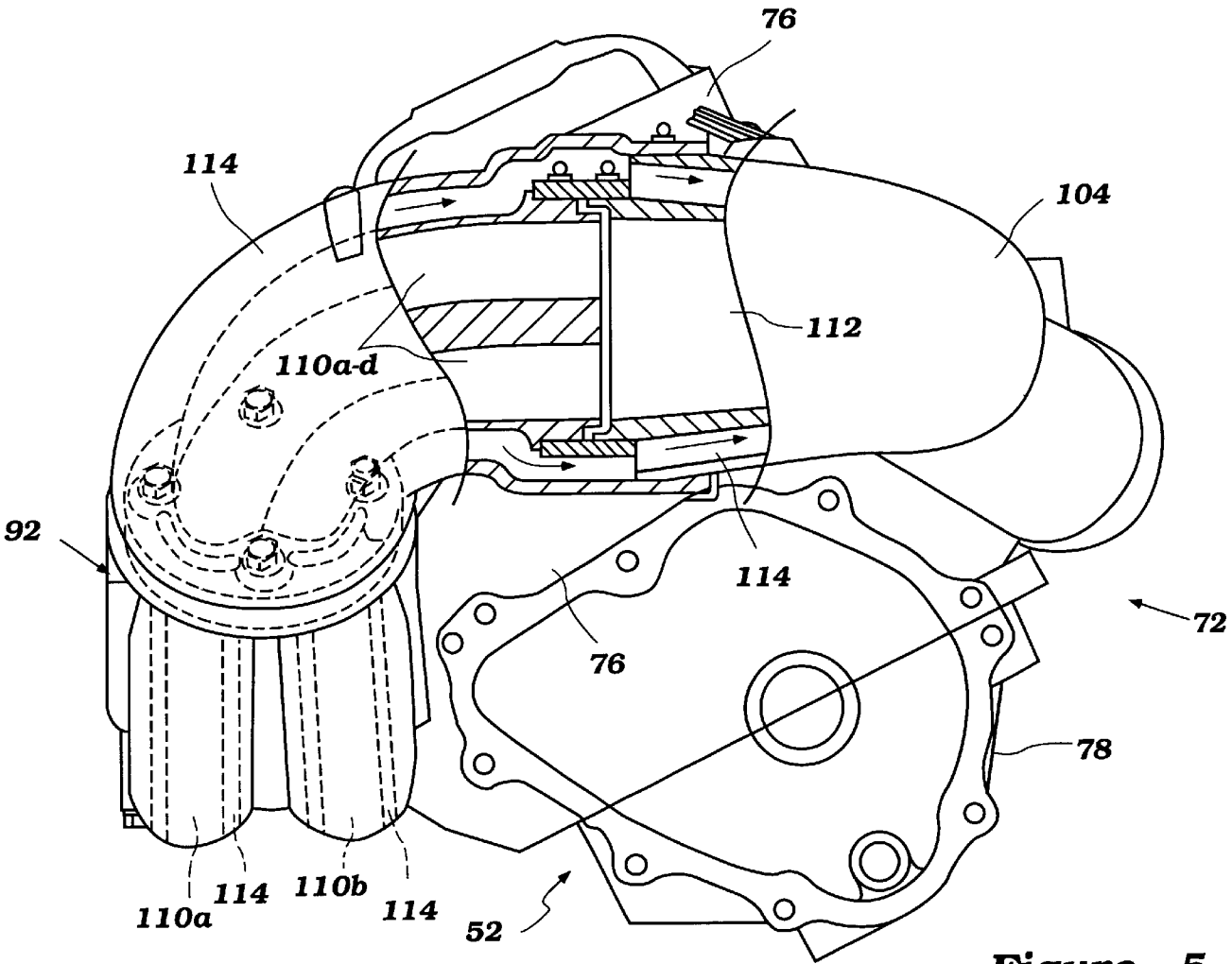
FIG. 5 is a partial sectional and front elevational view of the engine and exhaust system shown in FIG. 4.

With reference to FIG. 5, the engine 52 is formed of an engine body 72 having a cylinder block 74, a cylinder head 76 and a crankcase member 78. As is conventional, one piston 79 (FIG. 7B) is supported for reciprocation within each cylinder bore 65 (FIG. 7B) of the engine 52. Each piston 79 is connected to a crankshaft (not shown) of the engine 52 by a connecting rod (not shown). The crankshaft is journaled by a plurality of bearings within the engine body 72 to rotate about a crankshaft axis, which is generally parallel with the longitudinal axis of the watercraft 20.

The cylinder head 76 is provided with individual recesses which cooperate with their respective cylinder bores 65 and heads of the pistons 79 to form combustion chambers 80. Poppet-type intake valves are slidably supported in the cylinder head 76 in a known manner, and have their head portions engageable with valve seats so as to control the flow of the intake charge into the combustion chamber 80 through the intake passages. The intake valves are operated by an intake camshaft which is journaled in the cylinder head 76.

The cylinder head 76 also includes at least one exhaust passage for each of the combustion chambers 80. The exhaust passages emanate from one or more valve seats formed in the cylinder head 76, and cooperate with an exhaust system for discharging exhaust gases to the atmosphere. At least one exhaust valve is supported for reciprocation in the cylinder head 76 for each combustion chamber, in a manner similar to the intake valves. The exhaust valves are operated by an exhaust camshaft, which is journaled in the cylinder head 76. Both the intake and exhaust camshafts are driven by the crankshaft through a suitable drive arrangement. The drive arrangement may comprise, for example, a gear and chain arrangement or a pulley and belt arrangement, as is well known in the art. The intake and exhaust camshafts and the intake and exhaust valves form a valve train of the engine.

A suitable ignition system is provided for igniting the air and fuel mixture provided to each combustion chamber 80. Spark plugs 82 are fired by the ignition system, which preferably includes an electronic control unit (ECU) (not shown) connected to the engine 52 by one or more electrical cables. A pulser coil (not shown) which may be incorporated into the ECU, generates firing signals for the ignition system. In addition, the ignition system may include a battery for use in providing electric power to an electric starter, and the like.

Figure 4:
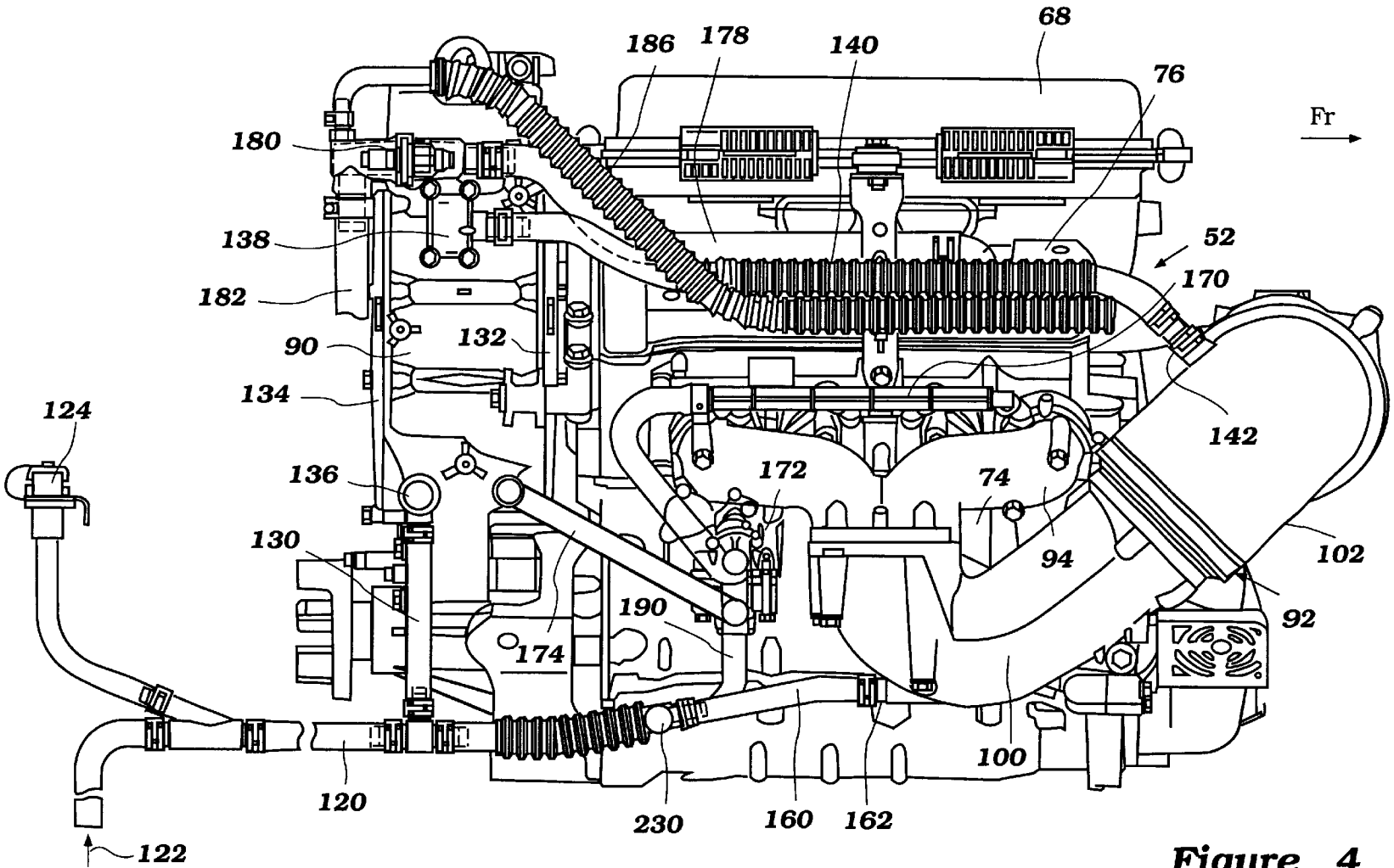
FIG. 4 is a starboard side elevational view of the engine and a portion of the exhaust system.

With reference to FIGS. 3 and 4, the watercraft 20 also includes a lubrication system. The lubrication system desirably includes a lubricant reservoir 90, a lubricant filter (not shown) and a lubricant pump (not shown). The lubricant pump is configured to circulate lubricant between the reservoir 90, the filter, and at least one lubricant gallery formed in the engine body 72. Preferably, the lubricant reservoir is in the form of a tank mounted to the rear of the engine body 72. The lubricant reservoir 90 preferably includes a lubricant fill tube (not shown) which extends upwardly to a lubricant fill port. The lubricant fill port is arranged to be accessible through the access opening in the seat pedestal 44 (FIG. 2).

The lubricant reservoir 90 communicates with the lubricant pump through lubricant supply and lubricant return passages (not shown). The lubricant pump can be in the form of a single pump or can comprise a supply pump and a return, or a "scavenge" pump. The lubrication functions of the lubrication system in the illustrated embodiment can be of a conventional type and, thus, further description of the lubrication function of the lubrication system is not deemed necessary for one of the ordinary skill in the art to make and use the present invention.

The engine 52 further includes an exhaust system to discharge burnt charges (i.e., exhaust gases) from the combustion chambers 80. In the illustrated embodiment, the exhaust system includes four exhaust ports (not shown). The exhaust ports are defined in the cylinder head 76 and communicate with associated combustion chambers 80. As mentioned above, the exhaust valves selectively connect and disconnect the exhaust ports of the combustion chambers. That is, the exhaust valves selectively open and close the exhaust ports.

As illustrated in FIGS. 1 through 5, the exhaust system includes an exhaust conduit 92 to guide exhaust gases from the exhaust ports to the atmosphere or, preferably, to the body of water in which the watercraft 20 is operating. The exhaust conduit includes an exhaust manifold 94 which, in turn, comprises a first exhaust manifold 96 and a second exhaust manifold 98 coupled with the exhaust ports on the starboard side of the engine 52 to receive exhaust gases from their respective ports. The first exhaust manifold 96 is connected with two of the exhaust ports and the second exhaust manifold 98 is connected with the other two exhaust ports. In a presently preferred embodiment, with reference to FIGS. 3 and 4, the first and second exhaust manifolds 96, 98 are configured to nest with each other.

Respective downstream ends of the first and second exhaust manifolds 96, 98 are coupled with a first unitary exhaust conduit 100. The first unitary exhaust conduit 100 is further coupled with a second unitary exhaust conduit 102. The second unitary exhaust conduit 102 is then coupled with an exhaust pipe 104, which extends to a rear side of the engine body 72.

With reference to FIGS. 1 and 2, the exhaust pipe 104 extends rearwardly along the port side of the engine body 72 and is connected to a forward surface of a water lock 106. A discharge pipe 108 extends from a top surface of the water lock 106 and transversely across the center plane $C_P$ of the watercraft 20. The discharge pipe 108 then extends rearwardly and opens at a stem of the lower hull section 24 in a submerged position. The water lock 106 inhibits the water in the discharge pipe 108 from entering the exhaust pipe 104, as is known in the art.

With reference to FIG. 5, preferably, at least the first and second unitary conduits 102, 104, have four exhaust passages 110*a–d* (only three shown), two of which are juxtaposed and communicate with the exhaust passages of the first manifold 96. The other two exhaust passages of the first and second unitary conduits 102, 104 are juxtaposed and communicate with the exhaust passages of the second manifold 98. The four exhaust passages 110*a–d* of the first and second unitary exhaust conduits 100, 102 open into a single exhaust passage 112 of the exhaust pipe 104.

Preferably, a water jacket 114 is formed in the space between the exhaust passages 110*a–d*, 112 and the outer wall of the first unitary conduit 100, the second unitary conduit 102, and the exhaust pipe 104. The water jacket 114 receives cooling water from the cooling system of the watercraft 20 to cool the exhaust conduit 92, as described in greater detail below.

In operation, the exhaust gases of the respective combustion chambers 80 move to the associated exhaust ports and then go to the first or second exhaust manifolds 96, 98, which are associated with the respective exhaust ports. The exhaust gases then pass through the associated exhaust passages of the first and second unitary exhaust conduits 100, 102. The exhaust passage coming from the respective combustion chambers 80, are separated from each other until they reach the downstream end of the second unitary exhaust conduit 102. The exhaust gases merged together when moving into the exhaust pipe 104 from the second unitary conduit 102. The exhaust gases flow through the exhaust pipe 104 and then enter the water lock 106. The exhaust gases move to the discharge pipe 108 from the water lock 106 and are finally discharged to the body of water at the stem of the lower hull section 24 in a submerged location. The water lock 106 primarily inhibits the water in the discharge pipe 108 from entering the exhaust pipe 104. Because the water lock 106 has a relatively large volume, it may function as an expansion chamber also.

The cooling system of the engine 52 preferably includes an exhaust cooling system, a lubricant cooling system, and an engine cooling system. Preferably, cooling water is supplied by the jet pump unit 61, which is pressurized by the rotation of the impeller. However, other suitable cooling water supply arrangements may be used, such as a mechanical pump coupled to the crankshaft, for example.

With reference to FIG. 6, a preferred embodiment of the present cooling system is illustrated schematically. In operation, water from the body of water in which the watercraft 20 is operating is drawn into the impeller housing 63 by the impeller. In a presently preferred embodiment, a primary coolant supply passage 120 extends from a positive pressure portion 122 of the impeller housing 63 to supply cooling water, or coolant, to various systems of the watercraft 20, such as the exhaust system, lubrication system and the engine body 72, as described in detail below. However, it is conceived that a plurality of coolant passages (not shown) can extend from the impeller housing 63 to independently provide coolant to the desired systems. In addition, a secondary water inlet 124 communicates with the supply passage 120 to permit draining of the cooling system or to permit an alternate supply of coolant to be introduced into the cooling system, for example when the engine 52 is operated while the watercraft 20 is not in a body of water.

A lubrication system coolant supply passage 130 branches from the primary supply passage 120 and delivers cooling water to water jackets (not shown) of the lubricant reservoir 90. With reference to FIG. 4, preferably the water jackets of the lubricant reservoir are formed between the outer surface of the reservoir 90 and a pair of cover members 132, 134 connected to front and rear sides of the reservoir 90, respectively. Side passages within the reservoir 90 allow fluid communication between the front and rear water jackets. Additionally, a plurality of coolant guide ribs may be disposed within the water jackets of the reservoir 90 to divide the water jackets into a plurality of distinct horizontal portions. Preferably, cooling water introduced into a lower end of the water jackets of the reservoir 90, through an inlet 136, and is guided in an upward direction by the guide ribs to an outlet 138 near a top end of the reservoir 90.

With reference to FIG. 6, as the cooling water exits the reservoir 90, it enters an exhaust system coolant supply passage 140, which delivers the cooling water to an upstream end of the second unitary exhaust conduit 102 through an inlet 142. The cooling water travels downstream through the water jacket 114 (FIG. 5) thereby cooling the exhaust conduit 92. Preferably, the cooling water exits the water jacket 114 near a downstream end of the exhaust pipe 104 through an outlet 144. From the outlet 144, the cooling water enters a discharge passage 146 (FIG. 5), which discharges the cooling water into the body of water in which the watercraft 20 is operating through an outlet 148.

As illustrated schematically in FIG. 6, a coolant passage 150 connects an inlet 152, which opens into the water jacket 114 of the exhaust pipe 104, to an outlet port 154. Thus, a portion of the cooling water within the water jacket 114 is directed through the coolant passage 150 and is discharged from the outlet port 154. Preferably, the outlet port 154 is in the form of a tell-tale port positioned on the hull 22 so as to produce a visible stream of discharged coolant which signals the operator of the watercraft 20 that the cooling system appears to be operational.

In addition to supplying the lubrication system supply passage 130 with cooling water, the primary supply passage 120 also supplies cooling water to an engine supply passage 160. Although the cooling water supplied to the engine supply passage 160 is primarily intended to cool the engine 52, the cooling water is first brought into thermal communication with a portion of the exhaust conduit 92 before being delivered to the engine 52. Advantageously, with such an arrangement, the temperature differential between the coolant and the engine 52 is maintained below a magnitude that may damage the engine 52, such as when the watercraft 20 is hot or is operating in cold water.

Cooling water within the engine supply passage 160 is introduced into the water jacket 114 of the first unitary exhaust conduit 100 through an inlet 162. The cooling water travels in an upstream direction (i.e., opposite the direction of exhaust flow) and then into water jackets 164 of the exhaust manifold 94.

A downstream engine coolant supply passage 170 extends from the water jacket 164 to deliver cooling water to the engine 52. Specifically, the supply passage 170 is coupled at its downstream end to a pressure-actuated valve 172 which, in turn, is coupled to the engine 52. The pressure actuated valve 172 permits cooling water to flow into the engine 52. Further, if the supply coolant pressure, and more specifically, the coolant pressure within the valve 172 itself, exceeds a predetermined threshold, the valve 172 permits coolant to flow to a coolant bypass passage 174 and bypass the engine 52.

In the illustrated embodiment, the coolant bypass passage 174 extends from the pressure-actuated valve 172 to a water jacket of the lubricant reservoir 90. Within the water jacket of the reservoir 90, coolant from the bypass passage 174 combines with coolant from the supply passage 130 and is supplied to the exhaust conduit 92, as described above.

Cooling water within the engine 52 moves through a water jacket 176 which, preferably, is formed within both the cylinder block 74 and the cylinder head 76 of the engine 52. A coolant passage 178 connects the water jacket 176 of the engine 52 to a temperature actuated valve, or thermostat 180. As is conventional, the thermostat 180 prohibits cooling water below a predetermined threshold temperature from passing through the thermostat 180 and permits cooling water at or above a predetermined threshold temperature to pass through the thermostat 180. From the thermostat 180, cooling water flows through a discharge passage 182 and is expelled through an outlet 184. The outlet 184 may be separate from or maybe the same as the outlet 148 described above.

A vent passage 186 also communicates with the cooling system, preferably slightly downstream from the thermostat 180, and extends to a discharge port 188, which may be in the form of a tale-tell port. As illustrated in FIG. 4, such an arrangement advantageously positions the connection between the vent passage 186 and the cooling system at substantially the highest portion of the cooling system. Such a placement allows any air entrained in the cooling water to be removed through the vent passage 186 and facilitates the cooling water flow through the remainder of the cooling system.

A drain passage 190 communicates with the water jacket 176 of the engine 52 through the pressure-actuated valve 172. The pressure-actuated valve 172 permits water to pass from the water jacket 176 to the drain passage 190. The drain passage 190 is connected to the primary supply passage 120 and is beneficial for allowing cooling water to drain from the engine 52 when the watercraft 20 is not in use. After the engine 52 has been shut off, cooling water within the water jacket 176 is able to drain through the drain passage 190 and in a reverse direction through the supply passage 120, where it is discharged through the positive pressure portion 122 of the jet pump unit 61.

Figure 7:
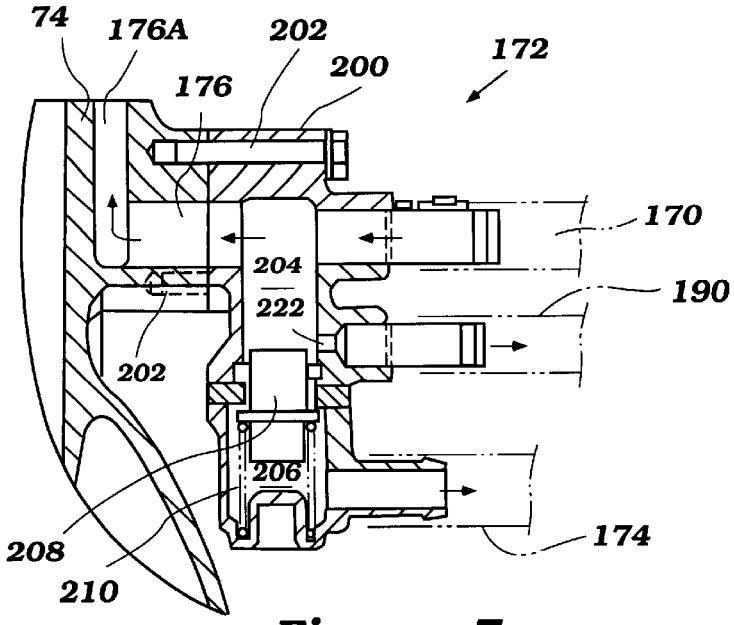
FIG. 7 is a cross-sectional view of a pressure-actuated valve within the cooling system of the engine of FIG. 3. The valve allows fluid communication between a cooling water supply passage, a drain passage and a water jacket of the engine, as well as selective communication with a bypass passage.

FIG. 7 illustrates a preferred embodiment of the pressure-actuated valve 172. The pressure-actuate valve 172 includes a valve body 200, which preferably is coupled to the cylinder block 74 of the engine 52 by a plurality of bolts 202 and communicates with a lower portion of the water jacket 176 of the engine 52. Preferably, the valve body 200 is coupled to the starboard side of the engine 52, as illustrated in FIG. 4.

The valve body 200 defines an internal chamber which is divided into an upper chamber portion 204 and a lower chamber portion 206 by a movable piston 208. The coolant supply passage 170, the drain passage 190 and the water jacket of the engine, referred to generally by the reference numeral 176, are all in direct communication with the upper chamber portion 204. The bypass passage 174 is in direct communication with the lower chamber portion 206. The movable piston 208 selectively permits fluid communication between the upper and lower chamber portions 204, 206 and, thus, permits cooling water to flow from the supply passage 170 to the bypass passage 174.

The piston 208 is biased into a closed, or upward, position by a biasing member, such as a spring 210. The piston 208 is opened in response to fluid pressure in the upper chamber portion 204 exceeding a predetermined threshold pressure, which is determined at least in part by the spring constant of the spring 210 and the surface area of the piston 208, transverse to its axis of motion, as may be determined by one of skill in the art. When the coolant pressure within the upper chamber portion 204 exceeds the predetermined threshold, the piston 208 moves in a downward direction against the biasing force of the spring 210 and permits coolant to flow from the upper chamber portion 204 to the lower chamber portion 206.

Preferably, the threshold pressure for the pressure-actuated valve 172 to open is below a pressure that may cause damage to the thermostat 180. Advantageously, with such an arrangement, the pressure-actuated valve 172 maintains the supply coolant pressure at, or below the threshold opening pressure of the valve 172. Thus, the coolant pressure within the thermostat 180 is inhibited from reaching a magnitude that may cause damage. Therefore, the preferred cooling system alleviates such a potential failure of the thermostat 180.

Figure 8A:
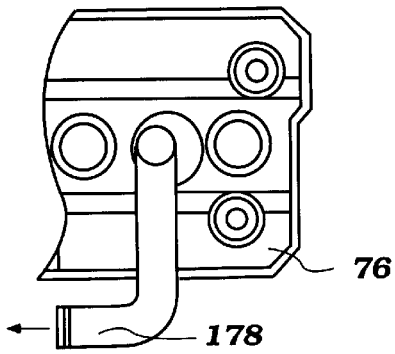
FIG. 8A is a top plan view of a portion of a cylinder head of the engine of FIG. 3.
Figure 8B:
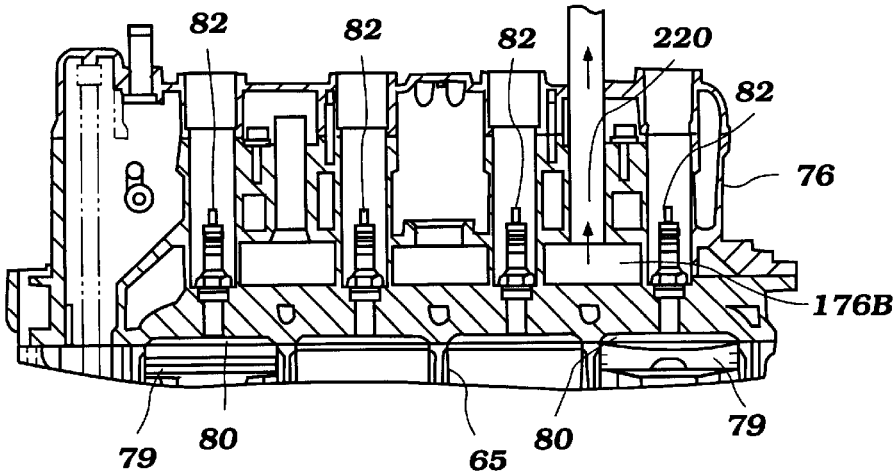
FIG. 8B is a cross-sectional view of the cylinder head of FIG. 8A.

The water jacket 176 of the engine 52 includes a cylinder water jacket portion 176A in fluid communication with a cylinder head water jacket portion 176B, as illustrated in FIGS. 7 and 8B. An outlet tube 220 extends upwardly from the cylinder head water jacket portion 176B through the cylinder head 76. Thus, cooling water which enters the engine water jacket 176 through the supply passage 170 flows in an upward direction through the cylinder water jacket portion 176A to the cylinder head water jacket portion 176B, thereby cooling the engine 52. Once the cooling water has cooled the engine 52, it is evacuated from the cylinder head water jacket portion 176B through the outlet 220. With reference to FIG. 8A, the outlet 220 is connected to the coolant passage 178, which routes the cooling water to the thermostat 180, as described above.

With reference to FIG. 7, the connection between the drain passage 190 and the upper chamber 204 of the pressure-actuated valve 172 includes a relatively small diameter opening, or restriction orifice 222. The restriction orifice 222 is preferably of a smaller diameter than the diameter of the supply passage 170 so that less cooling water is permitted to flow through the drain passage in comparison to the supply passage 170. Although, the restriction orifice 222 is illustrated as being located at the connection between the drain passage 190 and the pressure-actuated valve 172, it may nonetheless be positioned at any suitable point within the drain passage 190 to achieve the desired reduced flow rate, as may be determined by one of skill in the art.

As described above, upon normal operation of the watercraft 20, cooling water is routed through water jackets 164 of the exhaust manifold 94. Such an arrangement is preferred because the exhaust manifold 94 typically operates at the highest temperature of any component of the exhaust system. Therefore, the temperature of the cooling water is brought to a desired level even when the engine 52 is operating at a high speed and, thus, the flow rate of the cooling water is also high. With reference to FIG. 4, however, routing the cooling water through the manifold 94 results in the cooling water upstream from the engine 52 being vertically higher than at least a portion of the water jacket 176 of the engine 52. Accordingly, when the engine 52 is shut off, some cooling water is not drained and remains pooled in the water jacket 176 of the engine 52, which may lead to corrosion problems. Advantageously, the provision of a separate drain passage 190 alleviates this condition.

Furthermore, although the primary purpose of the drain passage 190 is to promote draining of cooling water from the engine 52, because it is connected to the cooling water supply passage 120, cooling water is also supplied to the engine 52 through the drain passage 190. The cooling water reaching the engine 52 from the drain passage 190 has not been brought into thermal communication with the exhaust system and, therefore, may be cold enough to damage the engine 52. Advantageously, the restriction orifice 222 reduces the flow of cooling water through the drain passage 190, during normal operation of the watercraft 20, in comparison to the flow of cooling water through the supply passage 170. As a result, the engine 52 primarily is supplied with cooling water that has been warmed by the exhaust system.

Figure 9:
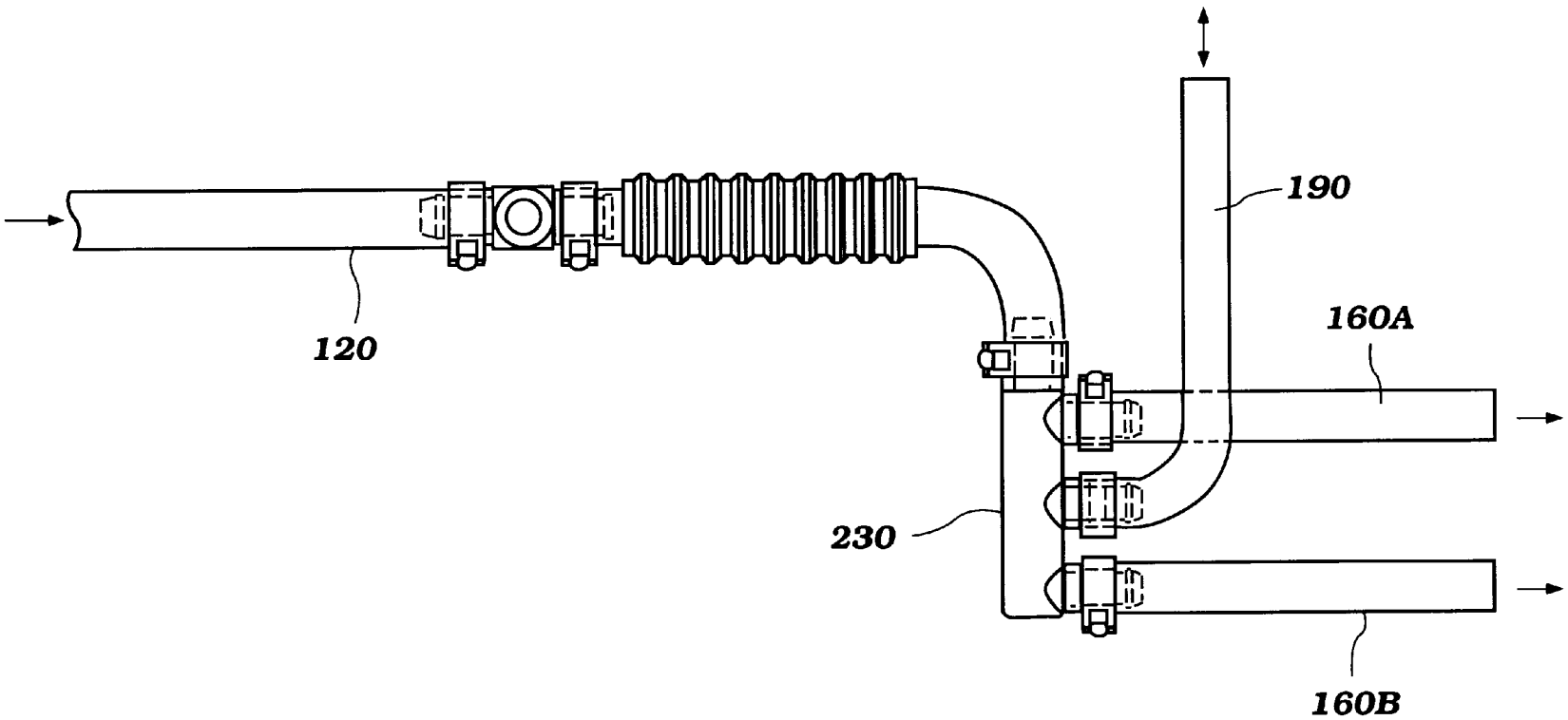
FIG. 9 is a top plan view of a junction between a main coolant supply passage, an engine coolant supply passage and the drain passage.

FIG. 9 illustrates a preferred junction between the primary cooling water supply passage 120, the engine cooling water supply passage 160 and the drain passage 190. In addition, although FIG. 6 illustrates a single engine cooling water supply passage 160, preferably a pair of engine supply passages 160A, 160B are provided. Both supply passages 160A and 160B receive cooling water from the primary supply passage 120 and it to the water jackets 164 of the exhaust manifold 94, as described above.

Preferably, the primary supply passage 120 is connected to the header 230 which supplies cooling water to both the engine supply passage 160 and the drain passage 190. In addition, when the engine 52 is shut off, cooling water that has drained from the engine 52 through the drain passage 190 flows into the supply passage 120 through the junction member 230. As described above, the cooling water moves through the supply passage 120, in a reverse direction to normal supply flow, and is drained through the positive pressure portion 122 of the jet pump unit 61.

Figure 10:
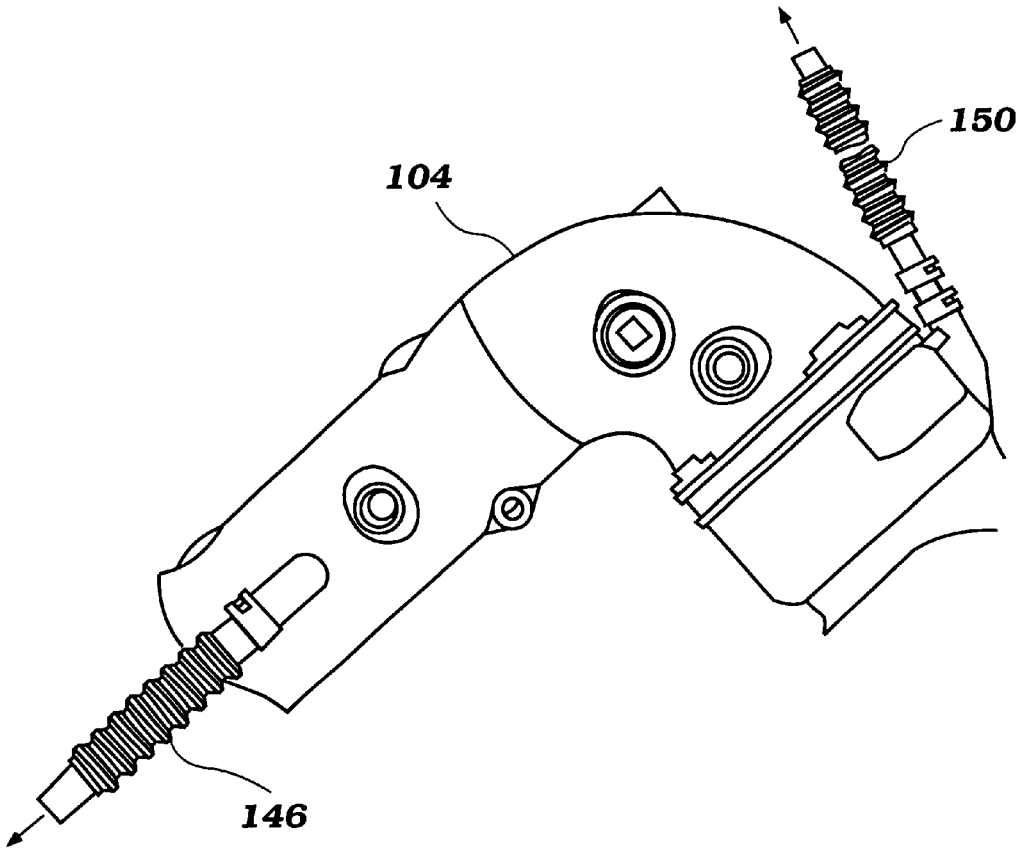
FIG. 10 is a top plan view of a muffler portion of the exhaust system having a pair of outlet ports communicating with a cooling water jacket therein.

FIG. 10 illustrates a portion of the exhaust pipe 104 showing a preferred arrangement for the drain passages 146 and 150. As illustrated, the drain passage 150 communicates with a forward end of the exhaust pipe 104 and directs a portion of the cooling water therein to the discharge port 154, or tell-tale port, as described above with reference to FIG. 6. Additionally, the drain passage 146 communicates with a downstream end of the exhaust pipe 104 and directs the remainder of the cooling water therein to the discharge port 148, which preferably is disposed within the tunnel 62 of the watercraft 20, as described above.

Of course, the foregoing description is that of certain features, aspects and advantages of the present invention to which various changes and modifications may be made without departing from the spirit and scope of the present invention. Moreover, a watercraft may not feature all objects and advantages discussed above. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. A watercraft comprising a hull defining an engine compartment, an internal combustion engine supported within the engine compartment, a propulsion device driven by the engine, the engine having an engine body defining a plurality of cylinders, an exhaust system configured to guide exhaust gasses from the engine body to the atmosphere, a cooling system comprising a first cooling jacket in thermal communication with the engine body, a second cooling jacket in thermal communication a portion of the exhaust system, and a coolant passage connecting the first coolant jacket with the second coolant jacket, the cooling system configured to urge cooling water from the second cooling jacket to the first cooling jacket during operation, the coolant passage extending to a point lower than portions of both the first and second cooling jackets, and a drain passage communicating with the point in the coolant passage, the drain passage being configured to drain cooling fluid from the first cooling jacket when the engine is off.

2. A small watercraft comprising a hull defining an engine compartment, an internal combustion engine supported within the engine compartment, a propulsion device driven by the engine, the engine having an engine body defining a cylinder and a cooling jacket in thermal communication with the cylinder, a cooling system in fluid communication with the cooling jacket, the cooling system supplying cooling fluid to the cooling jacket through a supply passage, a portion of the supply passage being above a portion of the cooling jacket, and a drain passage communicating with a lower portion of the cooling jacket, the drain passage being configured to drain cooling fluid from the cooling jacket, when the engine is off.

3. The small watercraft of claim 2, wherein a flow of cooling fluid within the supply passage is in thermal communication with an exhaust manifold of the engine before entering the cooling jacket.

4. The small watercraft of claim 3, wherein the drain passage communicates with the supply passage at a location upstream from the exhaust manifold, the drain passage having a restricted orifice, the orifice having a diameter smaller than a diameter of the supply passage.

5. The small watercraft of claim 2, wherein the cooling system additionally comprises a pressure actuated valve upstream from the cooling jacket, the valve permitting cooling fluid to bypass the cooling jacket when the cooling fluid within the valve is above a predetermined pressure.

6. The small watercraft of claim 5, wherein the cooling system additionally comprises a temperature actuated valve downstream from the cooling jacket, the temperature actuated valve substantially preventing cooling fluid from exiting the engine body when the cooling fluid within the cooling jacket is below a predetermined temperature.

7. The small watercraft of claim 6, additionally comprising a lubrication system including a lubricant reservoir, wherein the cooling system supplies cooling fluid to the reservoir independently of the engine.

8. A method of draining cooling fluid from a small watercraft engine having a first cooling jacket at least partially surrounding a cylinder of the engine, the method comprising supplying the cooling fluid to the engine through a supply passage, routing the supply passage into thermal communication with an exhaust manifold of the engine at a height above a portion of the first cooling jacket, routing the supply passage into fluid communication with the first cooling jacket to supply the cooling fluid to the first cooling jacket and cool the engine while it is running, and allowing the cooling fluid to drain from a lower portion of the first cooling jacket through a drain passage after the engine has stopped running.

9. A method of draining cooling fluid from a small watercraft engine having a first cooling jacket at least partially surrounding a cylinder of the engine, the method comprising supplying the cooling fluid to the engine through a supply passage, routing the supply passage into thermal communication with an exhaust manifold of the engine at a height above a portion of the first cooling jacket, routing the supply passage into fluid communication with the first cooling jacket to supply the cooling fluid to the first cooling jacket and cool the engine while it is running, allowing the cooling fluid to drain from a lower portion of the first cooling jacket through a drain passage after the engine has stopped running, and connecting the drain passage to a portion of the supply passage upstream from the exhaust manifold and allowing the cooling fluid to drain through the supply passage when the engine is not running.

10. The method of claim 9, wherein a portion of the cooling fluid flows through the drain passage and into the cooling jacket when the engine is running, additionally comprising permitting less flow through the drain passage than through the supply passage.

11. A marine engine comprising an engine body defining a cylinder, a cooling jacket at least partially surrounding the cylinder, a cooling system in fluid communication with the cooling jacket, the cooling system supplying cooling fluid to the cooling jacket through a supply passage, a portion of the supply passage being above a portion of the cooling jacket, and a drain passage communicating with a lower portion of the cooling jacket, the drain passage being configured to drain cooling fluid from the cooling jacket when the engine is off.

12. The marine engine of claim 11, wherein a flow of cooling fluid within the supply passage is in thermal communication with an exhaust manifold of the engine before entering the cooling jacket.

13. A marine engine comprising an engine body defining a cylinder, a cooling jacket at least partially surrounding the cylinder, a cooling system in fluid communication with the cooling jacket, the cooling system supplying cooling fluid to the cooling jacket through a supply passage, a portion of the supply passage being above a portion of the cooling jacket, and a drain passage communicating with a lower portion of the cooling jacket, the drain passage being configured to drain cooling fluid from the cooling jacket, wherein a flow of cooling fluid within the supply passage is in thermal communication with an exhaust manifold of the engine before entering the cooling jacket, and wherein the drain passage communicates with the supply passage at a location upstream from the exhaust manifold, the drain passage having a restricted orifice, the orifice having a diameter smaller than a diameter of the supply passage.

14. The marine engine of claim 11, wherein the cooling system additionally comprises a pressure actuated valve upstream from the cooling jacket, the valve permitting cooling fluid to bypass the cooling jacket when the cooling fluid within the valve is above a predetermined pressure.

15. The marine engine of claim 14, wherein the cooling system additionally comprises a temperature actuated valve downstream from the cooling jacket, the temperature actuated valve substantially preventing cooling fluid from exiting the engine body when the cooling fluid within the cooling jacket is below a predetermined temperature.

16. The marine engine of claim 15, additionally comprising a lubrication system including a lubricant reservoir, wherein the cooling system supplies cooling fluid to the reservoir independently of the engine.

17. A small watercraft comprising a hull defining an engine compartment, an internal combustion engine supported within the engine compartment, a propulsion device driven by the engine, the engine having an engine body defining a cylinder and a first cooling jacket in thermal communication with the cylinder of the engine, a supply passage that supplies cooling fluid to the engine, the supply passage being routed in thermal communication with an exhaust manifold of the engine at a height above a portion of the first cooling jacket and communicating with the first cooling jacket to supply the cooling fluid to the first cooling jacket to cool the engine while running, a drain passage which configured to allow the cooling fluid to drain from a lower portion of the first cooling jacket after the engine has stopped running, wherein the drain passage is connected to a portion of the supply passage upstream from the exhaust manifold and allows the cooling fluid to drain through the supply passage when the engine is not running.

18. A small watercraft in accordance with claim 17, wherein a portion of the cooling fluid flows through the drain passage and into the cooling jacket when the engine is running, additionally comprising permitting less flow through the drain passage than through the supply passage.

19. The watercraft of claim 1, wherein the point is positioned below the exhaust manifold.

20. The watercraft of claim 19, wherein the point is positioned below the cylinder block.

21. The watercraft of claim 1, wherein other portions of the exhaust system are lower than the point.

22. The watercraft of claim 1, wherein the cooling system does not comprise a pressure actuated valve upstream from the cooling jacket that permits cooling fluid to exit the cooling jacket when the cooling fluid within the valve is above a predetermined pressure.

23. The watercraft of claim 1, wherein the cooling system is configured to freely drain coolant from the cooling jackets when the engine is off.

24. The watercraft of claim 1, wherein the cooling system is configured to permit cooling fluid at atmospheric pressure to drain from the first and second cooling jackets through the drain passage.

25. The small watercraft of claim 2, wherein the drain passage communicates with a lower portion of the cooling jacket at a point below the exhaust manifold.

26. The small watercraft of claim 2, wherein the drain passage communicates with a lower portion of the cooling jacket at a point below the cylinder block.

27. The small watercraft of claim 2, wherein the cooling system is configured to permit cooling fluid at atmospheric pressure to drain from the first and second cooling jackets through the drain passage.

28. The small watercraft of claim 2, wherein the cooling system permits draining at atmospheric pressure.

29. The marine engine of claim 11, wherein the coolant drains freely when the engine is not running.

30. The marine engine of claim 11, wherein coolant drains from the cooling jackets without a pressure actuated valve upstream from the cooling jacket that permits cooling system to expel the cooling fluid when the cooling fluid within the cooling jacket is above a predetermined pressure.

* * * * *